US007955136B1

(12) United States Patent
Lai

(10) Patent No.: US 7,955,136 B1
(45) Date of Patent: Jun. 7, 2011

(54) ELECTRICAL CONNECTOR AND A FABRICATING METHOD THEREOF

(75) Inventor: Ming-Chun Lai, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/714,542

(22) Filed: Feb. 28, 2010

(51) Int. Cl.
*H01R 24/00* (2006.01)
*H01R 33/00* (2006.01)

(52) U.S. Cl. ..... 439/660

(58) Field of Classification Search ..... 439/660, 439/607.01
See application file for complete search history.

(56) References Cited

U.S. PATENT DOCUMENTS 7,285,016 B1 * 10/2007 Lai et al. ..... 439/607.01
7,413,467 B1 * 8/2008 Lai et al. ..... 439/489

* cited by examiner

*Primary Examiner* — Javaid Nasri
(74) *Attorney, Agent, or Firm* — Cheng-Ju Chiang

(57) ABSTRACT

An electrical connector includes a shell, an insulating housing, a plurality of contacts and a pair of strengthening plates. The insulating housing is formed with a contact tongue plate. If the electrical connector is assembled, the contacts are inserted into the insulating housing. The strengthening plates are inserted in the contact tongue plate. The contact tongue plate with the contacts and the strengthening plates are received in the shell. The strengthening plates will improve the structure of the contact tongue plate of the electrical connector to resist an external force such as a pressing force of a mating connector. The strengthening plates can prevent the contact tongue plate of the electrical connector from deformation and damage.

12 Claims, 5 Drawing Sheets

ELECTRICAL CONNECTOR AND A FABRICATING METHOD THEREOF

BACKGROUND OF THE INVENTION

1. Field of the Invention

The present invention relates to an electrical connector, more specifically, to an universal serial bus connector with a strengthening structure and a fabricating method of the universal serial bus connector.

2. The Related Art

According to the progress of the electrical technology, a personal computer is popular in daily life. The peripheral device applied to the personal computer is widely developed, such as a mouse, a printer, a joy stick, a louder speaker, a portable storage, etc. The peripheral device will connect to the personal computer by an electrical connector.

Because universal serial bus (USB) interface has advantages of hot plug-in, high convenience, high compatibility and high transmission speed, it is widely applied to the personal computer and the peripheral device. Hence, USB interface becomes one of the standard interfaces of the electronic devices. An USB connector is also widely used. Especially, the personal computer is arranged a female USB connector for connecting a male USB connector arranged in the peripheral device.

A conventional female USB connector includes a first metal shell, a first insulating housing and a plurality of first contacts. The first insulating housing includes a first tongue plate for supporting the first contacts. The first metal shell wraps the first insulating housing. A bottom surface of the first tongue plate of the first insulating housing and the first metal shell together define a first receiving space therebetween. The first contacts are protruded into the first receiving space from the bottom surface of the first tongue plate.

A conventional male connector includes a second metal shell, a second insulating housing and a plurality of second contacts. The second insulating housing includes a second tongue plate for supporting the second contacts. The second metal shell wraps the second insulating housing. A top surface of the second tongue plate of the second insulating housing and the second metal shell together define a second receiving space therebetween. The second contacts are protruded into the second receiving space from the top surface of the second tongue plate.

If the male USB connector plugs into the female USB connector in a correct status, the second tongue of the male USB connector will be inserted into the first receiving space of the female USB connector, and the first tongue of the female USB connector will be inserted into the second receiving space of the male USB connector. Hence, the first contacts of the female USB connector connect to the second contacts of the male USB connector.

If the male USB connector reversely plugs into the female USB connector in an erroneous status, the second tongue of the male connector will be inserted into a slit defined between the first metal shell and a top surface of the first tongue plate. The first tongue plate will be pressed by the second tongue plate to become deformed and be broken.

Furthermore, if the male USB connector plugs into the female USB connector in a correct status, the second tongue of the male USB connector will be horizontally inserted into the first receiving space of the female USB connector. If the male USB connector plugs into the female USB connector in an erroneous status, the second tongue of the male connector will be slantwise inserted into the first receiving space of the female USB connector. The first tongue plate will be pressed by the second tongue plate to become deformed and be broken.

SUMMARY OF THE INVENTION

An object of the present invention is to provide an electrical connector.

According to the invention, the electrical connector includes a shell, an insulating housing, a plurality of contacts and a pair of strengthening plates. The insulating housing is formed with a contact tongue plate received in the shell. The contacts are received in the insulating housing and exposed at a plane of the contact tongue plate. The strengthening plates are received in the contact tongue plate.

Another object of the present invention is to provide a fabricating method of the electrical connector.

According to the invention, the fabricating method of the electrical connector includes steps of forming the insulating housing with the contact tongue plate, inserting the contacts into the insulating housing; inserting the strengthening plates in the contact tongue plate; and receiving the contact tongue plate with the contacts and the strengthening plates in the shell.

The strengthening plates will improve the structure of the contact tongue plate to resist an external force such as a pressing force of a mating connector. The strengthening plates can prevent the contact tongue plate of the electrical connector from deformation and damage.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
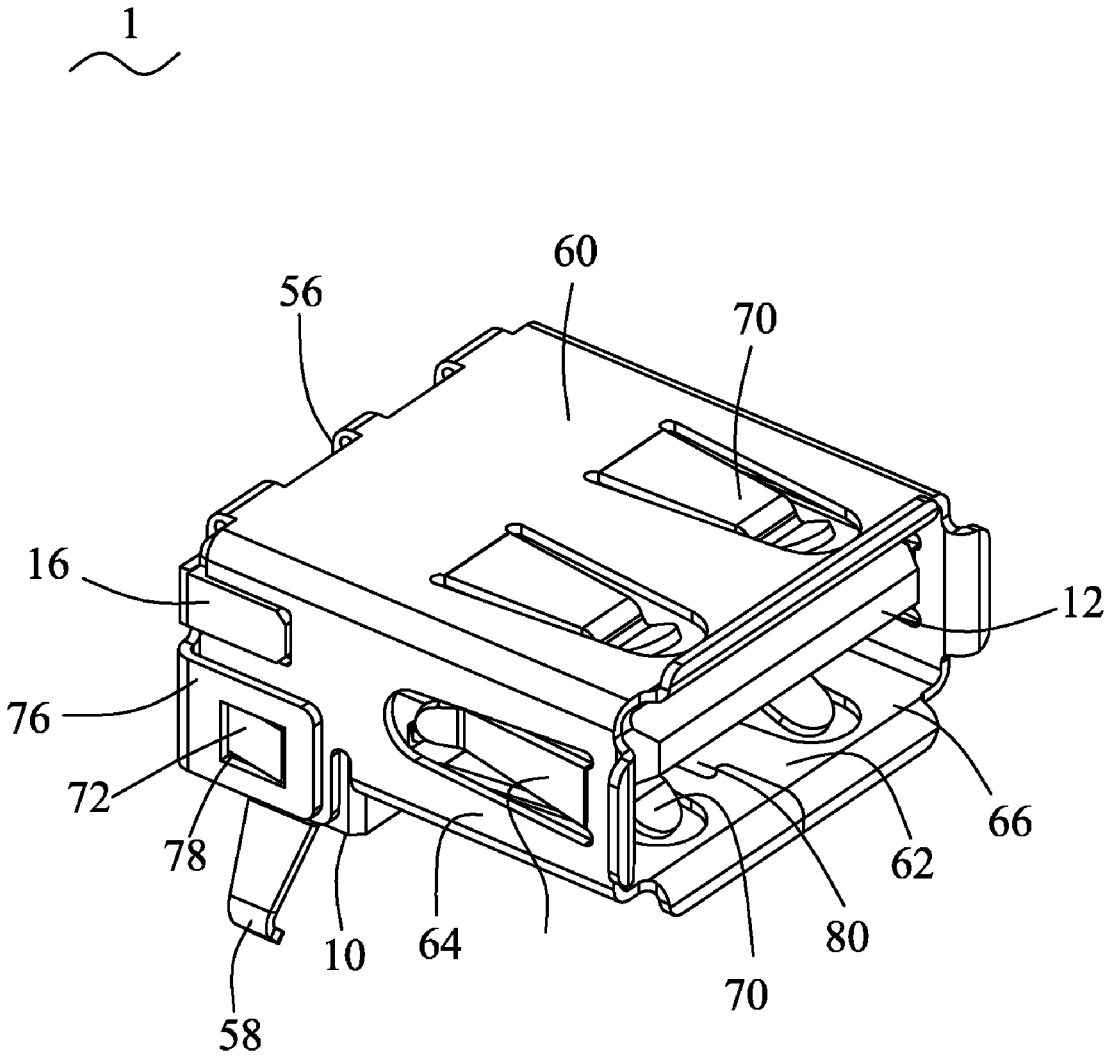
FIG. 1 is a perspective view of an USB connector.
Figure 2:
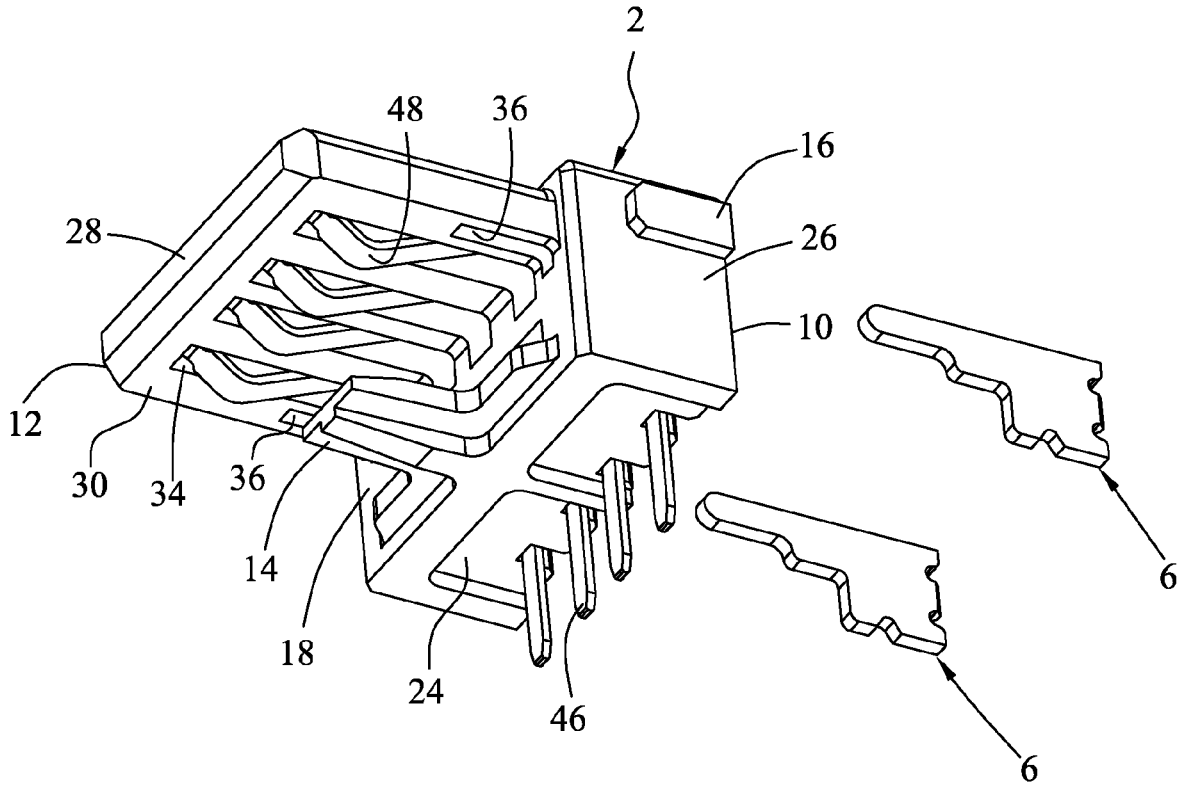
FIG. 2 is an exploded view of an insulating housing and a strengthening plate of the USB connector in FIG. 1.
Figure 3:
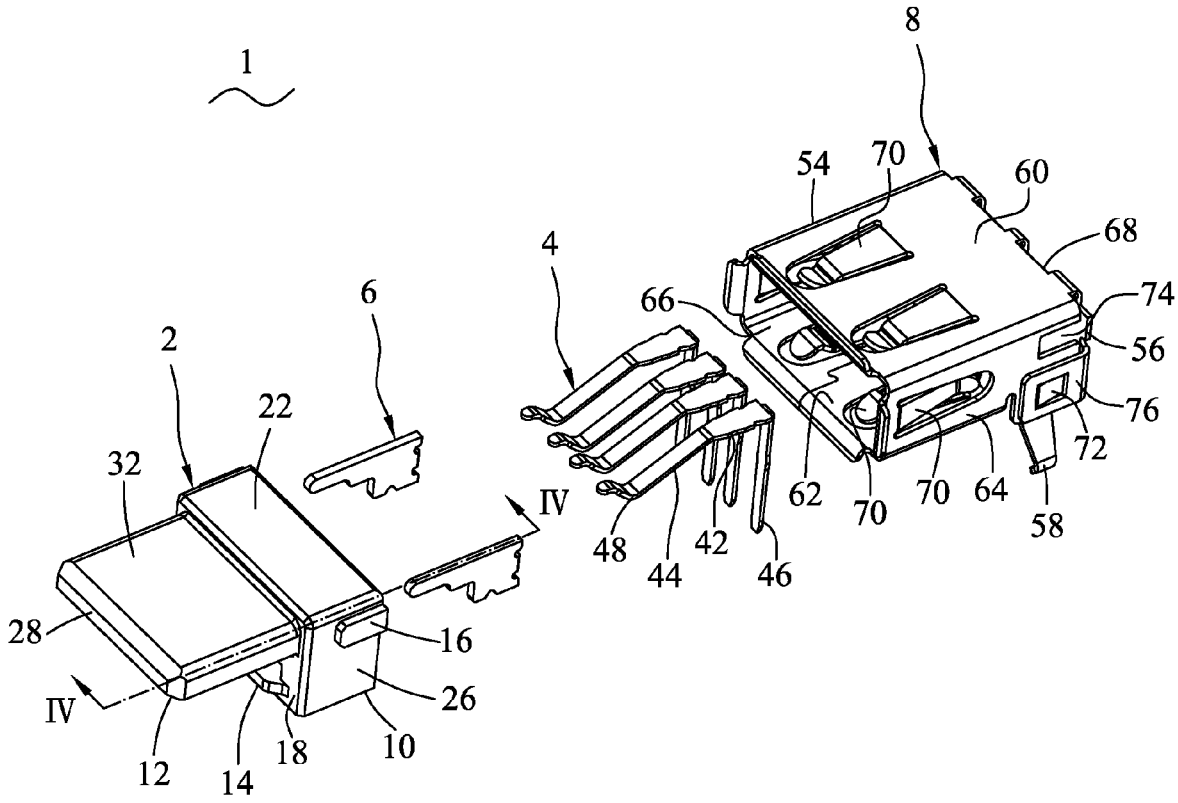
FIG. 3 is an exploded view of the USB connector in FIG. 1.
Figure 4:
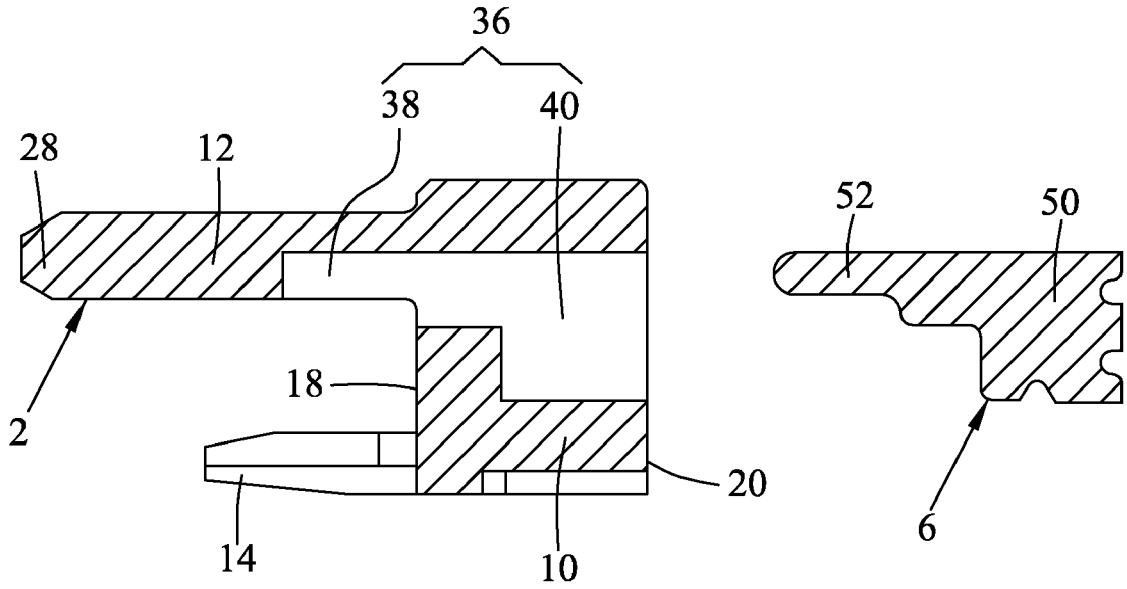
FIG. 4 is a cross section view of the insulating housing and the strengthening plate along IV-IV.
Figure 5:
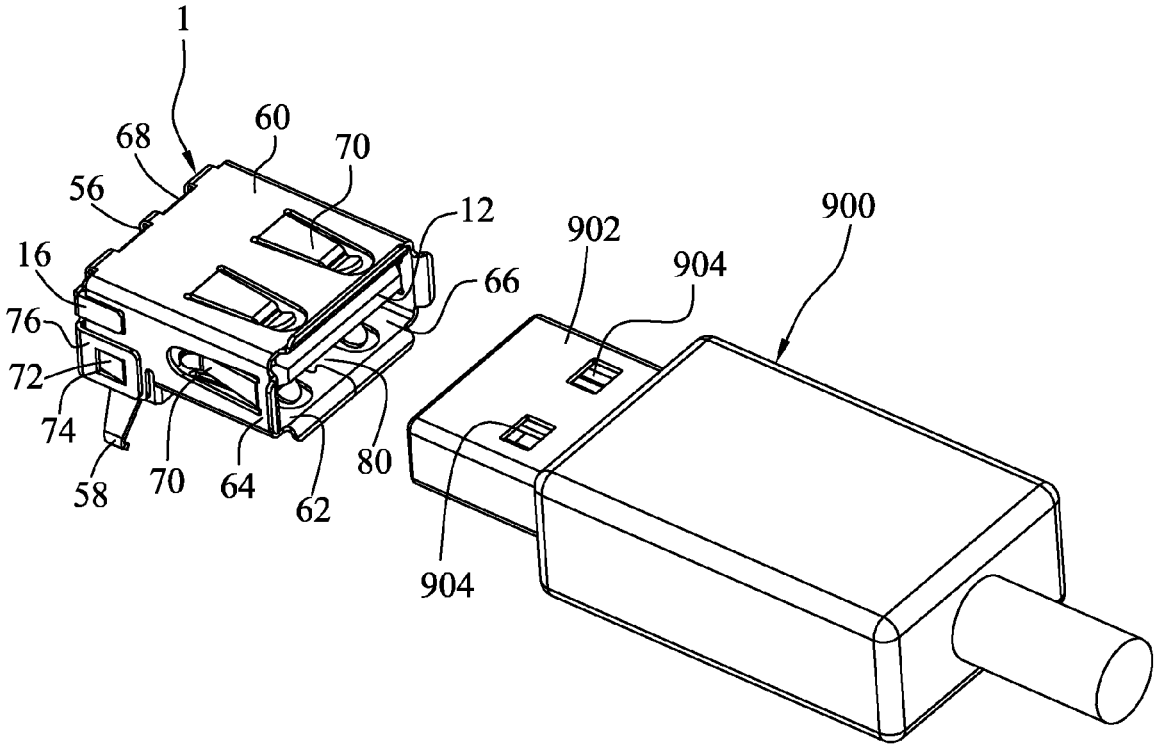
FIG. 5 is a perspective view showing the USB connector and a mating connector.

Please refer to FIG. 1 to FIG. 4. An electrical connector 1 according to the present invention includes an insulating housing 2, a plurality of contacts 4, a pair of strengthening plate 6 and a shell 8. The insulating housing 2 includes a main body 10, a contact tongue plate 12, a supporting tongue plate 14 and a pair of engaging blocks 16. In this case, the electrical connector 1 is an USB connector.

The main body 10 is formed of a rectangular shape and defines a front surface 18, a rear surface 20 opposite to the front surface 18, a top surface 22, a bottom surface 24 opposite to the top surface 22 and opposite side surfaces 26. The contact tongue plate 12 is extended forward from the front surface 18 of the main body 10. Especially, the contact tongue plate 12 is horizontally arranged adjacent to the top surface 22 of the main body 10.

The contact tongue plate 12 includes a front end portion 28, a bottom plane 30 and a top plane 32 opposite to the bottom plane 30. The bottom plane 30 of the contact tongue plate 12 defines a plurality of contact grooves 34 and a pair of positioning slits 36. The contact grooves 34 are horizontally extended from the top end portion 28 to the main body 10 to form a first receiving section.

The contact grooves 34 are penetrated the rear surface 20 of the main body 10 and vertically extended to the bottom surface 24 to form a second receiving section. The positioning slits 36 are extending from a rear portion of the contact tongue plate 12 and to the rear surface 20 of the main body 10. Especially, the positioning slits 36 are penetrated the rear surface 20 of the main body 10.

Each of the positing slits 36 is formed adjacent to each side surface 26 of the main body 10 and each side plate of the contact tongue plate and vertical to the contact tongue plate 12. The positioning slit 36 includes a first positioning section 38 formed in the contact tongue plate 12 and a second positioning section 40 formed in the main body 10.

The supporting tongue plate 14 is extended from the front surface 18 of the main body 10. The supporting tongue plate 14 is spaced from and parallel to the contact tongue plate 12. Especially, the supporting tongue plate 14 is arranged adjacent to the bottom surface 24 of the main body 10. Each of the engaging blocks 16 is laterally protruded from each of the side surfaces 26. Especially, the engaging blocks 16 and the contact tongue 12 are at the same level. The main body 10, the contact tongue plate 12, the supporting tongue plate 14 and the engaging blocks 16 are formed as one piece.

Each of the contacts 4 is stamped of a metal foil and includes a main portion 42, a contact arm 44 extended forward from the main portion 42 and a soldering leg 46 extended downward from the main portion 42. The contact arm 44 is curved to form a contact portion 48. The soldering leg 46 is vertical to the main portion 42. The body portion 42, the contact arm 44 and the soldering leg 46 are stamped as one piece.

Each of the strengthening plates 6 is punched of a metal foil and includes a main board 50 and a finger piece 52 extended forward from the main board 50. The main board 50 and the finger piece 52 are punched as one piece.

The shell 8 is stamped of a metal foil and includes a sleeve body 54, a cover 56 and a pair of grounding leg 58. The sleeve body 54 includes a top plate 60, a bottom plate 62 opposite to the top plate 60 and opposite side plates 64 connected to the top plate 60 and the bottom plate 62. The sleeve body 54 defines a front mating opening 66 and a rear opening 68 opposite to the front mating opening 66.

The top plate 60, the bottom plate 62 and the side plates 64 are punched to form at least one engaging arm 70 protruded inwardly. In this case, the top plate 60 and the bottom plate 62 are punched two engaging arm 70. The side plates 64 are punched a wedge 72 protruded outwardly and defined an engaging indentation 74. The wedges 72 are arranged adjacent to the rear opening 68. The engaging indentation 74 is defined at a rear edge of the side plate 64 and formed above the wedge 72.

The cover 56 is extended from a rear edge of the top plate 60 and bent downwardly to cover the rear opening 68. The opposite side edges of the cover 56 are extended an engaging tab 76. The engaging tab 74 is bent forwardly to arrange to beside the side plate 64, and defined an engaging hole 78 for engaging with the wedge 72.

If the electrical connector is assembled, each contact 4 is inserted into each contact groove 34 from the rear surface 20 of insulating housing 2. The main portion 42 and the contact arm 44 of the contact 4 is received in the first receiving section of the contact groove 34, and the soldering leg is received in the second receiving section of the contact groove 34.

Especially, the main portion 43 of the contact 4 is engaged with the first receiving section of the contact groove 34. The contact portion 48 of the contact 4 is protruded downward from the bottom plane 30 of the contact tongue plate 12 of the insulating housing 2. The free end of the soldering leg 46 is protruded from the bottom surface 24 of the main body 10 of the insulating housing 2.

Each of the strengthening plates 6 is vertically inserted into each positioning slit 36 from the rear surface 20 of the main body 10 of the insulating housing 2. The finger piece 52 of the strengthening plate 6 is received in the first positioning section 38 formed in the contact tongue plate 12, and the main board 50 of the strengthening plate 6 is received in the second positioning section 40 formed in the main body 10.

Before the shell 8 is assembled, the cover 56 is horizontally extended from the rear edge of the top plate 60, and the engaging tab 76 is bent downward. Hence, the insulating housing 2 is inserted into the shell 8 from the rear opening 68. The engaging blocks 16 of the insulating housing 2 is engaged into the engaging indentation 74 to position the insulating housing 2 inside shell 8.

The cover 56 of the shell 8 is bent downward to cover the rear opening 68. The engaging tabs 76 are brought to position to beside the side plates 64 respectively. The wedges 72 punched from the side plates 64 are engaged into the engaging holes 78 of the engaging tabs 76 respectively to fix the cover 56. The strengthening plates 6 are respectively retained in the positioning slits 36 by the cover 56.

The contact tongue plate 12 and the top surface 22 and the side surfaces 26 of the main body 10 are received in the shell 8. The bottom surface 24 of the main body 10 and the supporting plate 14 are exposed from the shell 8. Especially, the supporting plate 14 supports the bottom plate 62 of the shell 8 (not shown in figures).

The bottom plane 30 of the contact tongue plate 12 and the bottom plate 62 of the shell 8 define a receiving space 80 therebetween. The contact portion 48 of the contact 4 is protruded from the contact groove 34 and into the receiving space 80.

If the electrical connector 1 connects to a mating connector 900 including a metal shield 902, a mating tongue board received in the metal shield 902, a mating space defined between the mating tongue board and the metal shield 902, a plurality of mating terminals supported by the mating tongue board, and a pair of fixing holes 904 defined at a top portion and a bottom portion of the shield 902, the mating tongue board is plugged into the receiving space 80. The contact portion 48 of the contact 4 connects the mating terminal. The engaging arms 70 of the shell 8 are engaged into the fixing holes 904 of the metal shield.

If the mating connector is reversely plugged into the electrical connector 1, the strengthening plates 6 will support the contact tongue plate 12 to resist a pressing force from the mating connector. Furthermore, if the mating connector is slantwise plugged into the electrical connector, the strengthening plates 6 will support the contact tongue plate 12 to resisting from the mating connector.

As described above, the strengthening plates 6 will improve the structure of the contact tongue plate 12 to resist an external force such as the pressing force of the mating connector. The strengthening plates can prevent the contact tongue plate 12 of the electrical connector 1 from deformation and damage.

Furthermore, the present invention is not limited to the embodiments described above; diverse additions, alterations and the like may be made within the scope of the present invention by a person skilled in the art. For example, respective embodiments may be appropriately combined.

What is claimed is:

1. An electrical connector comprising:

a shell;

an insulating housing formed with a contact tongue plate received in the shell, the insulating housing comprising a main body formed with a front surface and a rear surface opposite to the front surface, the contact tongue plate extending from the front surface of the main body, a plurality of contact grooves defined at a plane of the contact tongue plate and extending to the rear surface of the main body, at least two positioning slits defined in the contact tongue plate and extending to the main body, the contact tongue plate being parallel to and offset from a top surface of the main body for a preset distance, and the contact tongue plate being parallel to and offset from a bottom surface of the main body for another preset distance;

a plurality of contacts received respectively in the plurality of contact grooves of the insulating housing and exposed at the plane of the contact tongue plate; and at least two strengthening plates received in the at least two positioning slits of the contact tongue plate respectively, each of the at least two strengthening plates formed with a main board received in the main body and a finger piece received in the contact tongue plate.

2. The electrical connector as claimed in claim 1, wherein the positioning slits are opened at the rear surface of the main body and defines a first positioning section formed at the contact tongue plate and a second positioning section formed at the main body and connected to the first positioning section, the strengthening plates vertically inserted into the positioning slits, the main board of the each of the at least two strengthening plates is received in the second positioning section, and the finger piece of the each of the at least two strengthening plates is received in the first positioning section.

3. The electrical connector as claimed in claim 2, wherein the contact grooves are penetrated the rear surface of the main body to form a first receiving section, and extended downward to a bottom surface of the main body to form a second receiving section, each of the contacts is formed with a main portion received in the first receiving section of each contact groove, a contact arm extended forward from the main portion and exposed from the plane of the contact tongue plate, and a soldering leg extended downward from the main portion and received in the second receiving section.

4. The electrical connector as claimed in claim 3, wherein the shell comprises a sleeve body defining at least one engaging indentation at each of side plates of the sleeve body, the main body is protruded at least one engaging block at each of side surfaces for engaging in the engaging indentation.

5. The electrical connector as claimed in claim 4, wherein the shell comprises a cover covering the rear surface of the main body of the insulating housing, the cover is extended to form at least one engaging tab from each of side edges thereof, the engaging tab is arranged to beside the side plate of the sleeve body and defines an engaging hole, each side plate of the sleeve body is formed with a wedge for engaging in the engaging hole.

6. The electrical connector as claimed in claim 5, wherein the front surface of the main body of the insulating housing is extended a supporting plate, the supporting plate is spaced from the contact tongue plate and arranged adjacent to the bottom surface of the main body for supporting an outer surface of a bottom plate of the sleeve body of the shell.

7. A method of fabricating an electrical connector comprising:

forming an insulating housing with a main body having a front surface and a rear surface, a contact tongue plate extending from the front surface of the main body, and being parallel to and offset from a top surface and a bottom surface of the main body, respectively, a plurality of contact grooves formed at a plane of the contact tongue plate and extending to the rear surface of the main body, and at least two positioning slits defined in the contact tongue plate and extending to the rear surface of the main body;

inserting a plurality of contacts into the plurality of contact grooves of the insulating housing respectively;

inserting at least two strengthening plates in the at least two positioning slits of the contact tongue plate, respectively; and receiving the insulating housing with the main body, the contact tongue plate, the contacts and the strengthening plates in a shell.

8. The method of fabricating an electrical connector as claimed in claim 7, further comprising:

forming a first positioning section of each positioning slit in the contact tongue plate, forming a second positioning section of each positioning slit in the main body to connected the first positioning section, and opening the second positioning section at the rear surface of the main body;

stamping a main board and a finger piece of each strengthening plate; and inserting each strengthening plate into each positioning slit vertically from the rear surface of the main body to position the finger piece in the first positioning section and position the main board in the second positioning section.

9. The method of fabricating an electrical connector as claimed in claim 8, further comprising:

forming a first receiving section of each contact groove from the plane of the contact tongue plate to the rear surface of the main body horizontally and opening the first receiving section at the rear surface;

forming a second receiving section of each contact groove at the rear surface of the main body vertically, and connecting the second receiving section to the first receiving section;

stamping each contact with a horizontal main portion, a contact arm extended forward from the main portion and a soldering leg extended downward from the main portion; and inserting each contact into each contact groove from rear surface of the main body to position the main body in the first receiving section, position the soldering leg in the section receiving section, and exposing the contact arm from the first receiving section.

10. The method of fabricating an electrical connector as claimed in claim 9, further comprising:

stamping the shell with a sleeve body defining a front opening and a rear opening, and stamping an engaging indentation at each side plates of the sleeve body, which is opened at a rear edge of each side plate;

forming an engaging block at each side surface of the main body; and inserting the insulating body into the sleeve body of the shell from the rear opening to position the engaging block in the engaging indentation.

11. The method of fabricating an electrical connector as claimed in claim 10, further comprising:

stamping a cover of the shell extended from a rear edge of a top plate of the sleeve body;

stamping an engaging tab of the shell from each side edge of the cover;

stamping an engaging hole of the shell at each engaging tab;

stamping a wedge of the shell at each side plate of the sleeve body;

bending the cover to cover the rear opening of the sleeve body; and bending the engaging to be positioned beside the side plate and to engage the wedge in the engaging hole.

12. The method of fabricating an electrical connector as claimed in claim 11, further comprising:

forming a supporting plate from the front surface of the main body, which is spaced from the contact tongue plate to support a bottom plate of the sleeve body of the shell.

* * * * *